United States Patent [19]

Marrah et al.

[11] Patent Number: 5,014,316

[45] Date of Patent: May 7, 1991

[54] COMPATIBLE QUADRATURE AMPLITUDE MODULATION DETECTOR SYSTEM

[75] Inventors: Jeffrey J. Marrah; Gregory J. Manlove, both of Kokomo; Richard A. Kennedy, Russiaville, all of Ind.

[73] Assignee: Delco Electronics Corporation, Kokomo, Ind.

[21] Appl. No.: 500,837

[22] Filed: Mar. 21, 1990

[51] Int. Cl.[5] ..... H04H 5/00

[52] U.S. Cl. ..... 381/15; 381/7; 329/304; 329/305; 329/306

[58] Field of Search ..... 381/7, 15; 329/304, 329/305, 306

[56] References Cited

U.S. PATENT DOCUMENTS 4,371,747 2/1983 Hilbert ..... 381/15
4,716,590 12/1987 Takahashi et al. ..... 381/15
4,845,750 7/1989 Ecklund et al. ..... 381/15

FOREIGN PATENT DOCUMENTS 2100555 12/1982 United Kingdom ..... 381/15

*Primary Examiner*—Jin F. Ng
*Assistant Examiner*—Sylvia Chen
*Attorney, Agent, or Firm*—Albert F. Duke

[57] ABSTRACT

An audio detector circuit forms L+R and L−R audio signals from an intermediate frequency compatible quadrature amplitude modulated signal in the form $(1+L+R)\cos(fct+\phi)$ where $\phi$ contains phase modulated L+R and L−R signals. An envelope detector generates an L+R audio signal and in-phase and quadrature phase detectors produce L+R and L−R audio signals, respectively. The difference between L+R outputs of the envelope and in-phase detectors are amplified to generate a cosine correction signal. Each detector includes a differential operational amplifier having an field effect feedback transistor coupled between each amplifier output and the corresponding input and an field effect transistor coupling the compatible quadrature amplitude modulated signal to the operational amplifier inputs. The impedances presented by the feedback transistor are varied by the cosine correction signal to remove the cosine component of the compatible quadrature amplitude modulated signal while frequency multiplication at the IF frequency rate provides the correct phase audio signal for matrix and noise processing.

24 Claims, 4 Drawing Sheets

500
CL'
507
509
P
501
515
N
512
517
CL 300
310
VC
342
352
335
355
332
340
322
315
320
325
330
362
CL2
305
CL1
301
VIF-
VIF+
303

COMPATIBLE QUADRATURE AMPLITUDE MODULATION DETECTOR SYSTEM

FIELD OF THE INVENTION

This invention relates to AM stereo receivers and more particularly to detector and audio processing circuits for compatible quadrature Amplitude Modulation (C-QUAM) signals in AM stereo receivers.

BACKGROUND OF THE INVENTION

Modern AM broadcast stations transmit Compatible Quadrature Amplitude Modulation (C-QUAM) signals to permit reception by both standard monophonic receivers using envelope detectors and by stereo AM receivers employing stereo detectors.

As is well known in the art, a stereo signal contains a left audio component L and a right audio component R. The carrier of a C-QUAM broadcast signal is amplitude modulated by a monophonic signal, $1+L+R$ and is phase modulated by the stereo information in the form of $(L+R)$ and $(L-R)$ signals. In producing the C-QUAM broadcast signal, the carrier is first phase modulated in quadrature with the $(L-R)$ and $(L+R)$ audio signals. The phase modulated signal is modified by multiplying the in-phase and quadrature phase components by a factor cos $\theta$ where $\theta$ is the arc tan $\{(L-R)/(1+L+R)\}$ and is then limited to remove any amplitude variations therein. The amplitude limited output of the phase modulator is amplitude modulated by a standard $1+L+R$ signal in high level transmitter stages. The C-QUAM broadcast signal resulting from the foregoing operations is of the form $(1+L+R)\cos(2\pi fct+\phi)$ where fc is the carrier frequency, t is time and $\phi$ represents the phase modulation signals $L+R$ and $L-R$ signals with the cosine $\theta$ term.

A variety of stereo receivers have been implemented to accommodate C-QUAM broadcast signals. Examples of representative receivers may be found in the article entitled *Quadrature System for AM Stereo* by Parker, Hilbert & Sakaie published in the *IEEE Transactions on Consumer Electronics*, Vol. CE-23. No. 4, November 1977 at pages 456–459 and in U.S. Pat. No. 4,192,968.

The detector for a C-QUAM stereo receiver includes an envelope detector for the amplitude modulation information in the received signal, a synchronous "I" in-phase detector for the phase modulation $L+R$ information in the received signal, a circuit for comparing the outputs of the envelope and in-phase detectors to provide a cosine correction signal, a synchronous "Q" quadrature-phase detector for the quadrature-phase modulation $L-R$ information, a cosine correction circuit to remove the cosine information from the in-phase and quadrature-phase signals and a stereo detection circuit to detect the presence or absence of stereo signals. The standard $L+R$ signal and $L-R$ stereo signals obtained from the envelope and quadrature phase detectors are processed to develop left and right channel signals. In the absence of a stereo signal of acceptable strength, the stereo receiver reverts to monophonic reception and its envelope detector produces the monophonic signal $L+R$.

Both bipolar and CMOS type circuits have been used in C-QUAM detectors. The finite transconductance of bipolar circuits, however, introduces distortion while the multipliers used in the bipolar circuits exhibit speed and switching deficiencies and require an output level shifter and impedance buffer. CMOS type circuits eliminate the distortion and switching problems associated with the bipolar circuits but lack gain control. As a result, an additional gain control stage is needed in CMOS detectors to provide the cosine correction.

SUMMARY OF THE INVENTION

A detector circuit that forms audio signals from a compatible quadrature amplitude modulated signal having $L+R$, $L-R$ and cosine components receives the compatible quadrature amplitude modulated signal and produces a signal representative of the cosine component thereof. Phase detecting means are responsive to the received compatible quadrature amplitude modulated signal to form one of the $L+R$ and $L-R$ audio signals. The phase detector comprises an amplifier having an input and an output. A controllable impedance connected between the input and the output of the amplifier is responsive to the cosine component representative signal to remove the cosine component of the compatible quadrature amplitude modulated signal.

In an illustrative embodiment of the invention, an audio detector circuit forms $L+R$ and $L-R$ audio signals from an intermediate frequency compatible quadrature amplitude modulated signal in the form $(1+L+R)\cos(2\pi fct+\phi)$ and phase modulated $L+R$ and $L-R$ signals with cosine components therein A cosine component representative signal is produced. Each phase detector includes a differential operational amplifier having a field effect feedback transistor connected between each amplifier output and the corresponding input and a field effect transistor coupling the compatible quadrature amplitude modulated signal to the operational amplifier inputs. The impedance presented by the feedback transistors is varied by the cosine correction signal so that cosine component of the phase modulated signal applied to the phase detector is removed while frequency multiplication at the IF frequency rate provides the correct phase audio signal for matrix and noise processing. A prescribed phase signal representative of the IF frequency carrier of the compatible quadrature amplitude modulated signal is applied to the gate electrodes of the coupling transistors to vary the coupling transistor impedance in accordance with the prescribed phase signal thereby forming a signal representative of one of the $L+R$ and $L-R$ audio signals.

The invention will be better understood from the following more detailed description taken with the accompanying drawings and claims.

DETAILED DESCRIPTION

Figure 1:
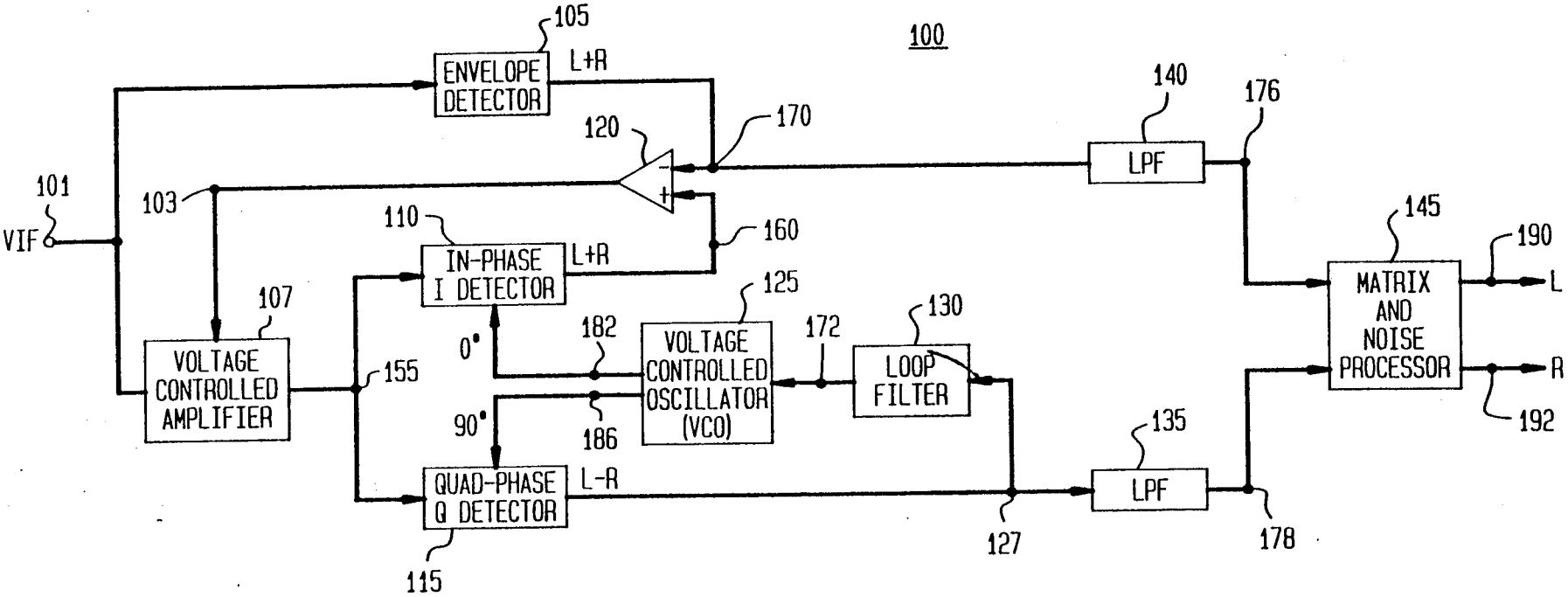
FIG. 1 (PRIOR ART)
FIG. 1 is a block diagram of the detector portion of a prior art compatible quadrature amplitude modulation AM stereo receiver.

Referring now to FIG. 1, there is shown a block diagram of a prior art stereo detector and audio processing circuit 100 that is adapted to detect C-QUAM, QUAM or monophonic broadcast signals. Stereo detector and audio processing circuit 100 of FIG. 1 comprises an input terminal 101, an envelope detector 105, a voltage controlled amplifier 107, an in-phase I detector 110, a quad-phase Q detector 115, an amplifier 120, a loop filter 130, a voltage controlled oscillator (VCO) 125, lowpass filters (LPF) 135 and 140 and a matrix and noise processor 145.

The input terminal 101 is connected to inputs of the voltage controlled amplifier 107, and the envelope detector 105. An output of the voltage controlled amplifier 107 is connected to inputs of in-phase detector 110 and the quad-phase Q detector 115 and to a terminal 155. An output of the quad-phase Q detector 115 is coupled to inputs of the loop filter 130 and the lowpass filter 135 and to a terminal 127. An output of the in-phase detector 110 is connected to a positive input of the amplifier 120 and to a terminal 160. An output of the envelope detector 105 is connected to a negative input of amplifier 120, to an input of LPF 140 and to a terminal 170. A first output of VCO 125 is coupled to a second input of detector 110 and to a terminal 182. A second output of VCO 125 is connected to a second input of detector 115 and to a terminal 186. An output of loop filter 130 is coupled to an input of VCO 125 and to a terminal 172. An output of the amplifier 120 is connected to a second input of the voltage controlled amplifier 107 and to a terminal 103. Outputs of lowpass filters 135 and 140 are connected to inputs of the matrix and noise processor 145 and to terminals 178 and 176, respectively. First (L) and second (R) outputs of matrix and noise processor 145 are connected to output terminals 190 and 192, respectively.

A signal VIF from an IF portion of the AM receiver is applied to the input terminal 101. The input IF signal VIF is an amplitude and/or phase modulated signal corresponding to the broadcast audio information having a center frequency of 450 kHz. In the case of a monophonic AM signal, the audio information is represented only by an amplitude modulated component of the IF signal. AM stereo IF signals have L+R and L−R phase modulated components in addition to the amplitude modulated component. The L+R audio information is in both the amplitude and the phase modulated components. The L−R audio information is only in the phase modulated portion of the IF signal. The in-phase component of the phase modulated signal is representative of the L+R audio signal while the quadrature phase component of the phase modulated signal corresponds to the L−R audio signal.

Signal VIF at the input terminal 101 is supplied to the phase detection portion of circuit 100 which includes the voltage controlled amplifier 107, the in-phase detector 110 and the quad-phase Q detector 115 and to the envelope detector 105. In the event a monophonic AM broadcast signal is received, the envelope detector 105 extracts the L+R signal from the amplitude modulated component in a manner well known in the art and supplies the L+R signal to the matrix and noise processor circuit 145 via the lowpass filter 140 The stereo detector and audio processing circuit 100 also detects and processes both QUAM and C-QUAM signals using both the envelope detector 105 and the phase detection portion of circuit 100.

When an AM stereo signal is received, the amplitude modulation component is detected in the envelope detector 105. The L+R signal is then available from the envelope detector 105. Signal VIF at the input terminal 101 passes through the voltage controlled amplifier 107 and is supplied to the inputs of the detectors 110 and 115. The detector 110 extracts the in-phase or "I" component of the phase modulated IF signal which corresponds to the L+R audio signal. The detector 115 extracts the quadrature phase or "Q" component of the phase modulated IF signal which corresponds to the L−R audio signal. Each of these detector circuits may comprise the aforementioned bipolar or CMOS type circuits.

The L−R output of the quadrature phase detector 115 is coupled to the matrix and noise processor 145 through the lowpass filter 135 and is coupled to the VCO 125 through the loop filter 130. The VCO 125 develops a pair of IF carrier frequency signals [i.e., a zero (0 degrees) signal and a quadrature (90 degrees) signal] at the IF center frequency. The in-phase, i.e., zero degree phase, IF carrier signal, is applied to the in-phase I detector 110 at the input (terminal 182) thereof to clock its operations. The quadrature phase, i.e. 90 degree phase, IF carrier signal is applied to the quad-phase Q detector 115 at the input thereof (terminal 186) and clocks the operations of the quad-phase Q detector 115.

As aforementioned, a C-QUAM signal at the terminal 101 is of the form $(1+L+R)\cos(2\pi fct+\phi)$. It is therefore necessary to remove the cosine component therein to obtain the L+R and L−R signals from the phase detectors 110 and 115. This is accomplished through the operation of the amplifier 120. The L+R signal from the detector 110 is not supplied to the matrix and noise processor 145 but is used to remove the cosine component of the C-QUAM signal present in the signal VIF at the input terminal 101. The L+R output of the envelope detector 105 is applied to the negative input of amplifier 120. The L+R signal from the in-phase I detector 110 is applied to the positive input of the amplifier 120. The difference between the positive and negative inputs to the amplifier 120, i.e., a cosine correction signal, is obtained at the output (terminal 103) of the amplifier 120. The cosine correction signal from the amplifier 120 is applied to the voltage controlled amplifier 107 wherein it is effects the removal the cosine component from the voltage controlled amplifier 107 output at the terminal 155. The voltage controlled amplifier 107 functions as a multiplier circuit to form the product of the signal VIF and the $1/\cos(\theta)$ signal derived from the output of the amplifier 120.

As is well known in the art, the output of envelope detector 105 contains the carrier and other high frequency components in addition to the L+R signal audio signal. The lowpass filter 140 removes such higher frequency components and prevents aliasing (i.e., the folding over of higher frequency components onto the L+R audio signal). The lowpass filter 135 receives the output of the quad-phase Q detector 115 and is operative to remove high frequency components from the quad-phase Q detector 115. It also prevents aliasing of these components into the L−R audio signals. The outputs of the lowpass filters 135 and 140 supply the standard L+R and L−R audio signals to the matrix and noise processor 145. The matrix and noise processor 145 combines the L+R and L−R audio signals to form left channel signal L and right channel signal R.

In the stereo detector and audio processing circuit 100, cosine correction is performed in the voltage controlled amplifier 107 and audio signal detection is performed by the envelope detector 105 and the in-phase I detector 110 and the quad-phase Q detector 115.

Figure 2:
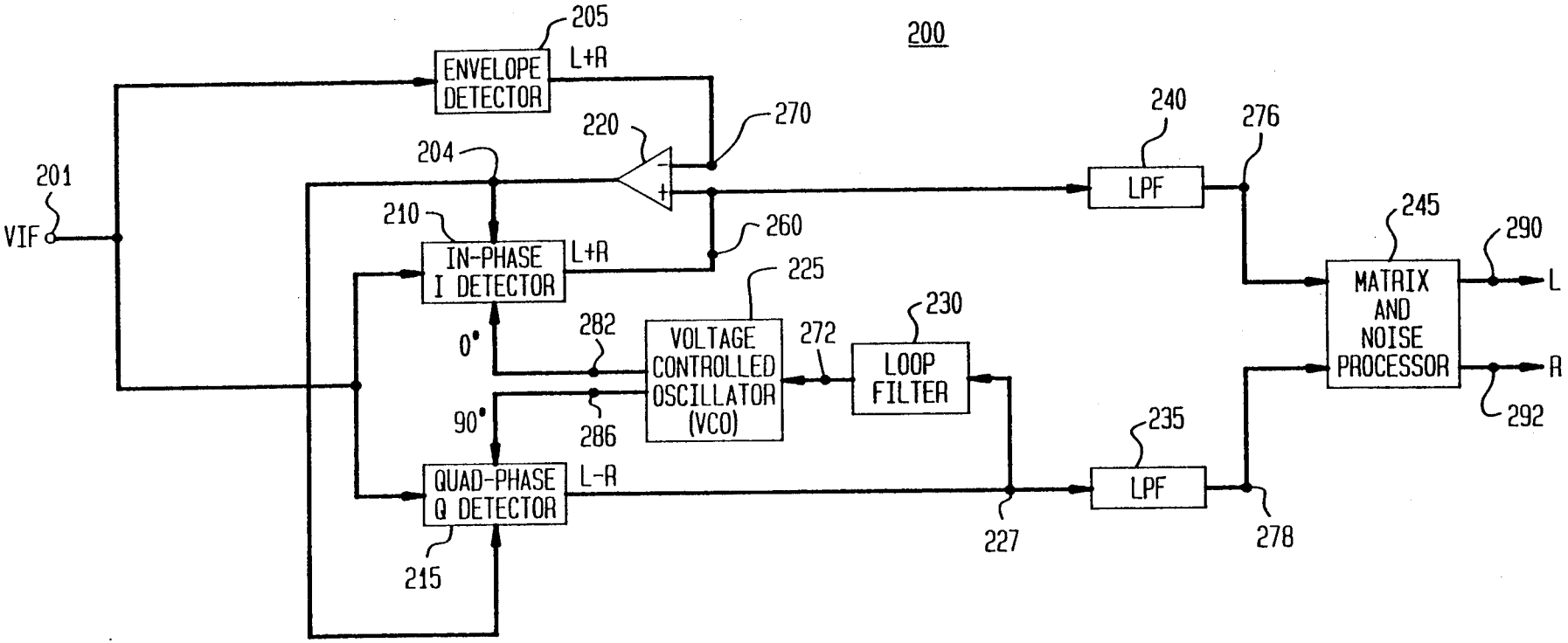
FIG. 2 is a block diagram of a detector portion of a compatible quadrature amplitude modulation AM stereo receiver in accordance with the present invention.

Referring now to FIG. 2, there is shown a block diagram of a stereo detector and audio processing circuit 200 in accordance with the present invention. The circuit 200 comprises an input terminal 201, an in-phase I detector circuit 210, a quad-phase Q detector 215, an envelope detector 205, an amplifier 220, a voltage controlled oscillator (VCO) 225, a loop filter 230, lowpass filters (LPF) 235 and 240, and a matrix and noise processor 245.

The input terminal 201 is coupled to an input of the envelope detector 205, to an input of the in-phase I detector 210, and to an input of the quad-phase detector 215. An input signal VIF is shown applied to the input terminal 201. An output of the envelope detector 205 is coupled to a negative input of the amplifier 220. During operation of the circuit 200, the envelope detector 205 generates an L+R output signal at the terminal 270. An output of the amplifier 220 is coupled to a second input of the in-phase I detector 210, to a second input of the quad-phase Q detector 215 and to a terminal 204. An output of the in-phase I detector 210 is coupled to a positive input of the amplifier 220, to the LPF 240 and to a terminal 260. During operation of circuit 200 detector 210 generates an L+R signal at the terminal 260. An output of the quad-phase Q detector 215 is coupled to an input of the loop filter 230, to an input of the LPF 235 and to a terminal 227. An output of the loop filter 230 is coupled to an input of the VCO 225 and to a terminal 272. An output of the VCO 225 is coupled to a third input (the 0 degree input) of the in-phase I detector 210 and to a terminal 282. A second output of the VCO 225 is coupled to a third input (the 90 degree input) of the quad-phase Q detector 215 and to a terminal 286. An output of the LPF 240 is coupled to an input of the matrix and noise processor 245 and to a terminal 276. An output of the LPF 235 is coupled to a second input of the matrix and noise processor 245 and to a terminal 278. A first output of the matrix and noise processor 245 is coupled to a terminal 290. A second output of the matrix and noise processor 245 is coupled to a terminal 292. During the operation of the circuit 200, output signals L and R are generated at output terminals 290 and 292, respectively.

Circuit 200 of FIG. 2 operates in a manner similar to that described with respect to circuit 100 in FIG. 1 except that the cosine correction function performed by the voltage controlled amplifier 107 of FIG. 1 is incorporated in the in-phase I detector 210 and the quad-phase Q detector 215 of FIG. 2. Referring to FIG. 2, the signal VIF from an IF portion of the AM stereo receiver is applied to the input terminal 201. The input IF signal has a center frequency of 450 kHz amplitude modulated by the L+R audio signal and may or may not be phase modulated by the L+R and L−R audio signals.

Signal VIF at the input terminal 201 is supplied directly to the inputs of the envelope detector 205, the in-phase I detector 210 and the quad-phase Q detector 215. If a monophonic AM broadcast signal is received, in-phase I detector 210 extracts the L+R signal from the amplitude modulated component in a manner well known in the art and supplies the L+R signal to the matrix and noise processor circuit 245 through LPF 240.

When an AM stereo signal is received, the amplitude modulation component is detected in the envelope detector 205. Signal VIF at terminal 201 is also supplied to an input of the in-phase I detector 210 and to an input of the quad-phase Q detector 215. The in-phase I detector 210 extracts the in-phase or "I" component of the phase modulated IF signal which corresponds to the L+R audio signal and couples it to LPF 240. The quad-phase Q detector 215 extracts the quadrature phase or "Q" component of the phase modulated IF signal which corresponds to the L−R audio signal which is shown as the output (terminal 227) of quad-phase Q detector 215.

The L−R output of the quad-phase Q detector 215 is supplied to the matrix and noise processor 245 through the LPF 235. The output of the quad-phase Q detector 215 is also applied to an input of the VCO 225 through loop filter 230. The VCO 225 develops a pair of carrier signals at the IF center frequency, e.g. 450 kHz, that bear a 90 degree relationship to each other. The in-phase, i.e., zero degree phase (0°) carrier signal (e.g., 450 kHz) is applied to the in-phase I detector 210 to clock the operations of the in-phase I detector 210. The quadrature phase, i.e., ninety degree (90°) phase carrier signal is applied to the quad-phase Q detector 215 via lead 286 to clock the operations of the quad-phase Q detector 215.

To remove the cosine component of the applied VIF signal, the L+R output of the envelope detector 205 is applied to the negative input of the amplifier 220 while the L+R signal from the in-phase I detector 210 is applied to the positive input of the amplifier 220. The difference between the positive and negative inputs to the amplifier 220, i.e. the cosine correction signal, is obtained at the output of the amplifier 220. The cosine correction signal from the amplifier 220 is applied to the in-phase I detector 210 wherein it effects the removal of the cosine component. The output of the amplifier 220 is also applied to the quad-phase Q detector 215 wherein it effects the removal of the cosine component from the L−R signal formed therein.

The lowpass filter 240 removes higher frequency components that are present in the output of the envelope detector 205 in addition to the L+R audio signal and prevents aliasing of the higher frequency components onto the L+R audio signal. In similar fashion, the lowpass filter 235 receives the output of the detector 215. The LPF 235 is operative to remove such high frequency components and prevent aliasing of these components into the L−R audio signal. The outputs of lowpass filters 235 and 240 supply the standard L+R and L−R audio signals to the matrix and noise processor 245. The matrix and noise processor 245 combines the L+R and L−R audio signals to form the left channel signal L and the right channel signal R.

Figure 3:
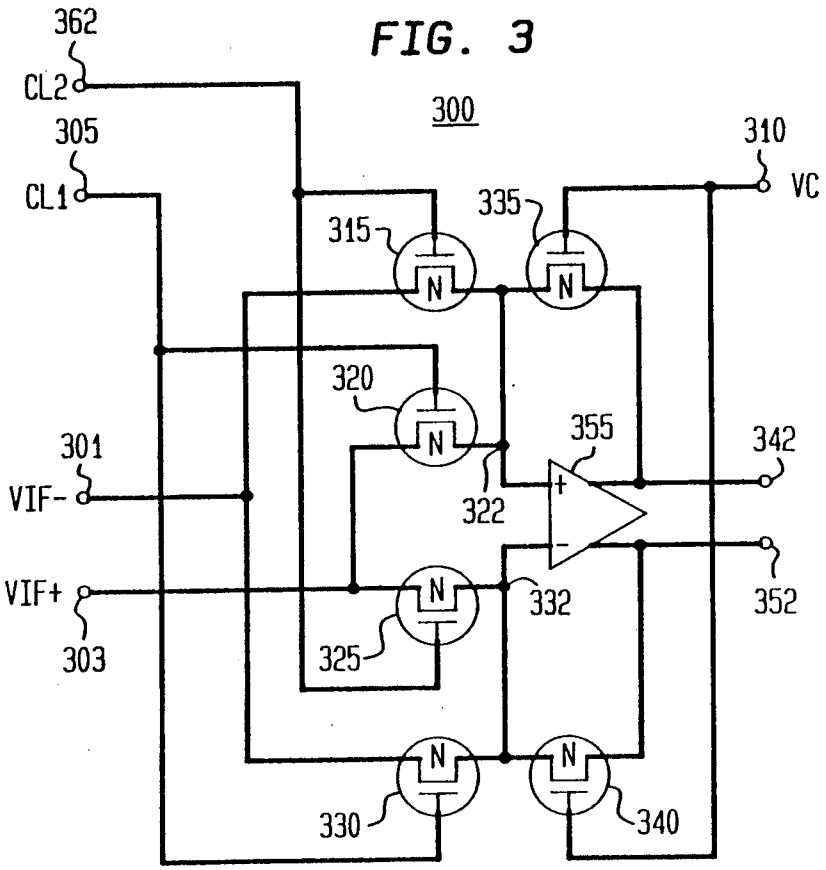
FIG. 3 is a schematic diagram of one embodiment of a phase detector in accordance with the present invention.

Referring now to FIG. 3, there is shown a schematic diagram of a combined cosine correction and phase detector circuit 300 in accordance with the present invention. Circuit 300 can serve as the in-phase I detector 210 of FIG. 2 when clocked by the zero phase clock signal from the VCO 225 in FIG. 2 or as the quad-phase Q detector 215 of FIG. 2 when clocked by the 90 degree clock signal from the VCO 225. The circuit 300 comprises n-channel field effect transistors 315, 320, 325, 330, 335 and 340, and a differential operational amplifier 355. Each of the transistors has a source, a drain and a gate. The amplifier has a positive input, a negative input and first and second outputs.

The sources of transistors 315 and 330 are coupled to an input terminal 301 which is shown with a signal VIF− applied thereto. The sources of transistors 320 and 325 are coupled to an input terminal 303 which is shown with a signal VIF+ applied thereto. The inputs of the gates of transistors 320 and 330 are coupled to an input terminal 305 and to a signal CL1. The gates of transistors 315 and 325 are coupled to a terminal 362 and to a clock signal CL2. The drains of transistors 315 and 320 are coupled to the source of transistor 335, to the positive input of the amplifier 355 and to a terminal 322. The drains of transistors 325 and 330 are coupled to the source of transistor 340, to the negative input of the amplifier 355 and to a terminal 332. The first output of the amplifier 355 is coupled to the drain of transistor 335 and to a first output terminal 342 of the circuit 300. The second output of the amplifier 355 is coupled to the source of transistor 340 and to a second output terminal 352 of the circuit 300. The gates of transistors 335 and 340 are coupled to a terminal 310 which is shown with a control voltage VC applied thereto.

In FIG. 3, a differential IF signal VIF+, VIF− is applied between input terminals 301 and 303. IF signal VIF− is supplied to the sources of transistors 315 and 330 via the input terminal 301. The drain of transistor 315 is coupled to the positive input of the operational amplifier 355 and the drain of transistor 330 is coupled to the negative input of the operational amplifier 355. Consequently, the current through transistor 315 is controlled by the clock signal CL1 applied to the gate of transistor 315. In like manner, the current flow through transistor 330 is controlled by the clock signal CL2 applied from the clock terminal 305. The impedance between the input terminal 301 and the terminal 322 has a value determined by the clock signal CL2 applied to the gate of transistor 315 while the impedance between the input terminal 301 and the terminal 332 has a value determined by the clock signal CL1 applied to the gate of transistor 330.

The clock signals CL1 and CL2 are non-overlapping square wave signals occurring at the IF center frequency (e.g., 450 kHz). Transistors 315, 320, 325 and 330, under control of the non-overlapping clock signals C11 and CL2, form a multiplier that extracts the L+R or L−R component of differential signal VIF+, VIF−. These transistors are turned on and off by the clock signal applied thereto. Transistors 320 and 330 are enabled (biased or turned on) by clock signal CL1 at the same time transistors 313 and 325 are disabled (disabled or turned off) by the complement clock signal CL2. When transistors 320 and 330 are conducting, signal VIF− is applied to terminal 332 at the negative input of the operational amplifier 355 through transistor 330 and signal VIF+ is applied to terminal 322 at the positive input of the operational amplifier 355 through transistor 320. In the interval when complement clock CL2 causes transistors 315 and 325 to conduct, the signal VIF− is applied to the terminal 322 at the positive input of the operational amplifier 355 through transistor 315 and the signal VIF+ is applied to the terminal 332 at the negative input of operational amplifier 355 through transistor 325. The reversal of the polarity of differential signal VIF+, VIF− at a rate corresponding to the IF center frequency produces modulation products which include the L+R or L−R audio signal as well as the IF center frequency.

In addition to functioning as a multiplier to provide detection, the circuit 300 of FIG. 3 also removes the cosine component of the C-QUAM signal. This is done by controlling the gain of the detector 300 responsive to the cosine correction signal from the output (terminal 204 in FIG. 2) of the amplifier 220 in FIG. 2. The cosine correction signal from the amplifier 220 of FIG. 2 is applied as control voltage VC to the gates of feedback transistors 335 and 340. As a result, the impedance at transistors 335 and 340 varies in accordance with the magnitude of control voltage VC applied to the gate thereof. Transistors 335 and 340 are matched so that the impedances exhibited between the source and drain electrodes thereof are substantially the same.

The impedance of transistors 315, 320, 325 and 330 is determined by the magnitude of the clock voltages applied to the gates thereof. Consequently, the impedance presented between the sources and drains of these transistors is controlled. Transistors 315, 320, 325 and 330 are physically matched by design. The impedance across each transistor (e.g., transistor 315) when switched "on" by the clock signal applied thereto is preset to a known value. When switched "off", each transistor (e.g., transistor 315) exhibits a high impedance that does not affect the gain of the detector 300.

The varying impedance exhibited by the feedback transistors 335 and 340 responsive to cosine varying control voltage VC and the known "on" impedances of transistors 315, 320, 325 and 330 responsive to the clock signals applied thereto control the gain of the detector 300 and thereby remove the cosine component in differential signal VIF+, VIF−. The signal between the output terminals 342 and 352 is the detected signal L+R or L−R. Where the clock signals CL1 and CL2 are 0° clock signals obtained from the VCO 225 in circuit 200 of FIG. 2, the circuit 300 of FIG. 3 functions as the in-phase I detector 210 of FIG. 2 and provides the detected L+R signal. Where the clock signals CL1 and CL2 are 90° phase clock signals obtained from the output of the VCO 225 in the circuit 200 of FIG. 2, the circuit 300 of FIG. 3 functions as the quad-phase Q detector 215 and provides the phase detected L−R signal.

Figure 4:
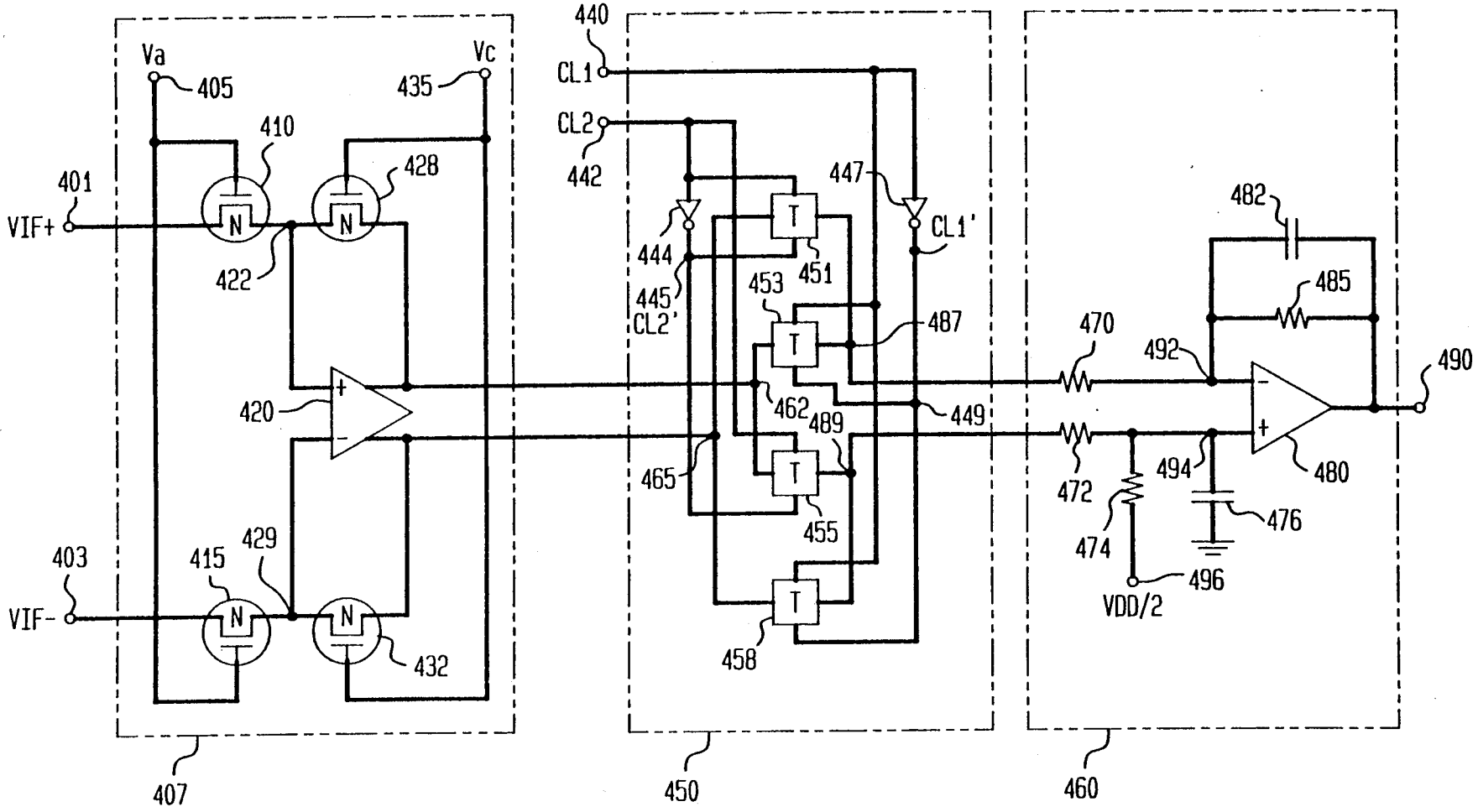
FIG. 4 is a schematic diagram of another embodiment of a phase detector in accordance with the present invention.

Referring to FIG. 4, there is shown a schematic diagram of a combined cosine correction and phase detector circuit 400 in accordance with the present invention. The circuit 400 comprises a cosine correction circuit (shown within as a dashed rectangle) 407, a frequency multiplier circuit (shown within as a dashed rectangle) 450 and a differential to single end converter (shown within as a dashed rectangle) 460. The cosine correction circuit 407 comprises n-channel transistors 410, 415, 428 and 432, and a differential operational amplifier 420. The frequency multiplier circuit 450 comprises clock inverters 444 and 447, and transmission gates 451, 453, 455 and 458. The differential to single end converter 460 comprises input resistors 470, 472, and 474, an input capacitor 476, an operational amplifier 480, a feedback capacitor 482 and a feedback resistor 485. Each of the transistors has a gate, a source and a drain. The first amplifier has a positive and a negative input and first and second outputs. The second amplifier has positive and negative inputs and an output. Each of the capacitors has a first and second terminal. Each of the transmission gates has first and second input/output terminals and first and second control terminals.

A first input terminal 401 of the circuit 407 is coupled to the source of transistor 410 and is shown with a signal VIF+ applied thereto. A second input terminal 403 of the circuit 407 is coupled to the source of transistor 415 and is shown with a signal VIF− applied thereto. The gates of transistors 410 and 415 are coupled to a terminal 405 with is coupled to a voltage source Va. The gates of transistors 428 and 432 are coupled together to a terminal 435 which is coupled to a voltage source VC. The drain of transistor 410 is coupled to the source of transistor 428, to the positive input of amplifier 420 and to a terminal 422. The drain of transistor 415 is coupled to the source of transistor 432, to the negative input of amplifier 420 and to a terminal 429. The first output of amplifier 420 is coupled to the drain of transistor 428, to first input/outputs of transmission gates 453 and 455 of circuit 450 and to a terminal 462. The second output of amplifier 420 is coupled to the drain of transistor 432, to first input/output terminals of transmission gates 451 and 458 of circuit 450 and to a terminal 465.

An input terminal 440 of circuit 450 to which is applied a signal CL1 is coupled to an input of the inverter 447 and to the first control terminals of transmission gates 453 and 458. An input terminal 442 of circuit 450 to which is coupled a signal CL2 is coupled to the input of inverter 444 and to the first control terminals of transmission gates 451 and 455. The output of inverter 444 is coupled to the second control terminals of transmission gates 451 and 455 and to a terminal 445. The output of inverter 447 is coupled to the second control terminals of transmission gates 453 and 458 and to a terminal 449. The second input/outputs of transmission gates 451 and 453 are coupled to a first terminal of resistor 470 of circuit 460. The second input/output terminals of transmission gates 455 and 458 are coupled to a first terminal of resistor 472 of circuit 460.

A second terminal of resistor 470 is coupled to the negative input of amplifier 480, to the first terminal of resistor 485, to the first terminal of capacitor 482, and to a terminal 492. The second terminal of resistor 472 is coupled to the first terminal of resistor 474, to the first terminal of capacitor 476, to the positive input of amplifier 480, and to a terminal 494. The output of amplifier 480 is coupled to a second terminal of resistor 485, to, a second terminal of capacitor 482, and to a circuit 460 output terminal 490. The second terminal of resistor 474 is coupled to a terminal 496 and to a voltage supply (not shown) having an output voltage VDD/2. The second terminal of capacitor 476 is coupled to ground. The cosine correction circuit 407 is operative to remove the cosine component of a differential C-QUAM signal applied between terminals 401 and 403 in FIG. 4. Transistors 410 and 415 are matched to provide the same current conduction characteristics between their sources and drains. Transistor 410 supplies the VIF+ signal to the positive input terminal of the operational amplifier 420 while transistor 415 supplies the VIF− signal to the negative input of the operational amplifier. The conduction characteristics of transistors 410 and 415 are set by control signal Va applied to their gate electrodes from terminal 405 so that the impedance between the source and drain of transistor 410 is substantially the same as the impedance between the source and drain of transistor 415. Control signal Va is a DC voltage that may be fixed or may be a function of a receiver condition.

The feedback transistors 428 and 432 are also matched to have substantially the same conduction characteristics over their operating ranges. Consequently, the impedance between the source and drain of transistor 428 is substantially equal to the impedance between the source and drain of transistor 432. The gain of the operational amplifier 420 is determined by the source-drain impedances of transistors 428 and 432 and the source-drain impedances of the input transistors 410 and 415. As described with respect to the operation of feedback transistors 335 and 340 of the embodiment 300 in FIG. 3, the cosine correction signal from amplifier 220 in circuit 200 of FIG. 2 is supplied to the gate electrodes of both transistors 428 and 432. As a result, the gain of the circuit 407, which is a function of the impedances presented by the input transistors 410 and 415 and the feedback transistors 428 and 432, varies with the cosine correction signal at the gate electrodes of transistors 428 and 432. This in effect causes the VIF signal to be multiplied by a factor of $1/\cos\theta$ thereby removing the cosine component present in any differential C-QUAM signal VIF+, VIF− between the input terminals 401 and 403.

The frequency multiplier circuit 450 and the differential to single end converter 460 cooperate to provide a signal at the output terminal 490 that includes the detected L+R or L−R audio signal as well as other modulation products. In the frequency multiplier circuit 450, the clock signal CL1 at terminal 442 and its complement CL1' from clock inverter 447 are supplied to the transmission gates 453 and 458 while clock signal CL2 at terminal 444 and its complement CL2' from clock inverter 444 are applied to the transmission gates 451 and 455. The clock signals CL1 and CL2 are non-overlapping square waves generated at the IF center frequency by the VCO circuit 225 in FIG. 2. 0° phase clock signals are used when the circuit 400 operates as in-phase I detector 210 to form the L+R signal and 90° phase clock signals are employed when the circuit 400 operates as the quad-phase Q detector 215 in FIG. 2 to form the L−R signal. The transmission gates 451, 453, 455 and 458 transfer the differential output of the operational amplifier 420 to the negative and positive inputs of the operational amplifier 480 through the resistors 470 and 472.

Figure 5:
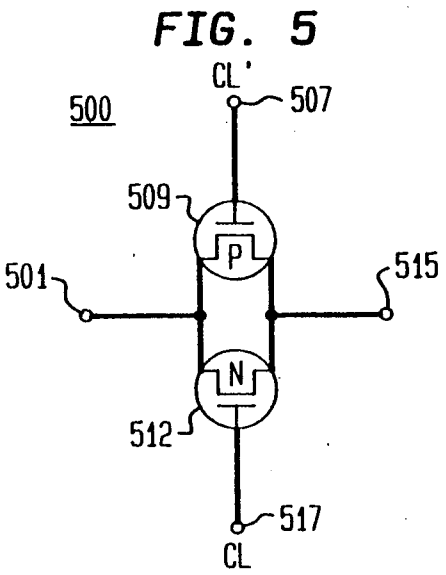
FIG. 5 is a schematic diagram of a circuit illustrating the operation of a transmission gate that is used in the embodiment of the present invention shown in FIG. 4.

Referring now to FIG. 5, there is shown a transmission gate 500 that may be used as the transmission gates 451, 453, 455 and 458 in the circuit of FIG. 4. The transmission gate 500 comprises a p-channel field effect transistor 509 and an n-channel field effect transistor 509. The drain of transistor 512 is coupled to the source of transistor 512 and to a first input/output terminal 501. The source of transistor 512 is coupled to the drain of transistor 509 and to a second input/output terminal 515. The gate of transistor 509 is coupled to a terminal 507 which is shown with a signal CL' applied thereto. The gate of transistor 512 is coupled to a terminal 517 which is shown with a signal CL applied thereto. CL and CL' are complementary signals.

In FIG. 5, transistors 509 and 512 operate as low impedance switches which pass signals between their sources and drains (terminals 501 and 515) when the clock signal CL' applied to the gate of transistor 509 is low (typically ground) and the clock signal CL applied to the gate of transistor 512 is high. When the clock signal CL' is positive (a high or "1") and the clock signal CL is negative or ground a zero ("0"), both transistors 509 and 512 are disabled (biased off or turned off) and no signal passes between the terminals 501 and 515 since a high impedance, essentially an open circuit exists between the terminals 501 and 515. In this condition, the transmission gate is said to be in an "off" state or open. Signals pass in both directions between the terminals 501 and 515 when transistors 509 and 512 are enabled (biased on or turned on) by the clock signals CL and CL'. In this condition, the transmission gate is said to be closed or in an "on" state.

Referring again to the frequency multiplier 450 in FIG. 4, the clock signals CL1 and CL2 are non-overlapping square waves at the IF carrier frequency. When the clock signal CL1 and its complement CL1' from clock inverter 447 bias the transmission gates 453 and 458 to their "on" states (i.e., low impedance states), the transmission gates 451 and 455 are switched off to their "off" (open) states (i.e., a high impedance or open circuit states). The transmission gate 453 connects the terminal 462 to the terminal 487 and the resistor 470 while the transmission gate 458 connects the terminal 465 to the terminal 489 and the resistor 472. In the interval when the clock signal CL2 and its complement CL2' from the clock inverter 444 enables the transmission gates 451 and 455 to their "on" states, the transmission gates 453 and 458 are disabled to their "off" (i.e., a high impedance or open circuit) states.

The transmission gate 455 connects the terminal 462 to the terminal 489 and the resistor 472 and the transmission gate 451 connects the terminal 465 to the terminal 487 and the resistor 470. In this way, the differential output of the operational amplifier 420 is applied to the inputs of the operational amplifier 480 with one polarity when the clock signal CL1 and its complement CL1' switch on the transmission gates 453 and 458 and with the opposite polarity when the clock signal CL2 and its complement CL2' enable the transmission gates 451 and 455. The polarity reversal occurs at the IF center frequency rate so that modulation products are generated. If the circuit 400 is employed as the in-phase I detector 210 in the circuit of FIG. 2, the clock signals CL1 and CL2 obtained from the VCO 225 are 0° phase square waves at the IF center frequency and the circuit 400 produces the L+R audio signal and higher frequency modulation products. The circuit 400 operates as the quad-phase Q detector 215 in the circuit 200 of FIG. 2 to form the L−R audio signal when the clock signals CL1 and CL2 are 90° phase square waves at the carrier frequency from the VCO 225.

It is to be understood that the specific embodiments described herein are intended merely to be illustrative of the spirit and scope of the invention. Modifications can readily be made by those skilled in the art consistent with the principles of this invention.

The embodiments of the invention in which an exclusive property or privilege is claimed are defined as follows:

1. An audio detector circuit for a compatible quadrature amplitude modulated signal having a carrier, an L+R component, an L−R component, and a cosine component comprising:

means for receiving the compatible quadrature amplitude modulated signal;

means responsive to the received compatible quadrature amplitude modulated signal for producing a signal representative of the cosine component therein; and detecting means responsive to the received compatible quadrature amplitude modulated signal for producing one of the L+R and L−R audio signals comprising:

an amplifier having an input and an output; and variable impedance means coupled between the input and the output of the amplifier responsive to the produced cosine component representative signal for removing the cosine component from the compatible quadrature amplitude modulated signal.

2. The audio detector circuit of claim 1 wherein the amplifier further comprises:

means responsive to the received compatible quadrature amplitude modulated signal for producing a signal representative of the carrier component of the received compatible quadrature amplitude modulated signal; and variable impedance means coupled to the output of the amplifier responsive to the produced carrier signal for forming a signal corresponding to a prescribed one of the L+R and L−R audio signals.

3. The audio detector circuit of claim 1 wherein the amplifier further comprises:

means responsive to the received compatible quadrature amplitude modulated signal for producing a signal representative of the carrier component of the received compatible quadrature amplitude modulated signal; and variable impedance means coupled between the means for receiving compatible quadrature amplitude modulated signal and the input of the amplifier responsive to the produced carrier signal for forming a signal corresponding to a prescribed one of the L+R and L−R audio signals.

4. An audio detector circuit for a compatible quadrature amplitude modulated signal having L+R, L−R and cosine components comprising:

means for receiving the compatible quadrature amplitude modulated signal;

means responsive to the received compatible quadrature amplitude modulated signal for producing a signal representative of the cosine component therein; and detecting means responsive to the received compatible quadrature amplitude modulated signal for producing one of the L+R and L−R audio signals comprising:

an amplifier including input means and output means;

first controllable impedance means coupled between the means for receiving the compatible quadrature amplitude modulated signal and the amplifier input means;

means for controlling the value of the first controllable impedances; and second controllable impedance means coupled between the input and output means of the amplifier responsive to the cosine component representative signal for removing the cosine component from the received compatible quadrature amplitude modulated signal.

5. The audio detector circuit of claim 4 wherein second controllable impedance means comprises:

at least one field effect transistor having source, drain and gate electrodes, the source electrode and drain electrodes being coupled between the input and the output means of the amplifier; and the cosine component representative signal producing means being coupled to the gate electrode of the at least one controllable impedance field effect transistor.

6. The audio detector circuit of claim 4 wherein the first controllable impedance means comprises:

at least one field effect transistor having source, drain and gate electrodes, the source and drain electrodes being coupled between the means for receiving the compatible quadrature amplitude modulated signal and the amplifier input means; and the means for controlling the value of the first controllable impedance means comprises means for applying a voltage signal to the gate electrode of the at least one field effect transistor.

7. The audio detector circuit of claim 4 wherein:

the compatible quadrature amplitude modulated signal is a differential signal;

the amplifier comprises a differential amplifier having first and second inputs and first and second outputs;

the first controllable impedance means comprises:

a first variable impedance device coupled between the means for receiving the differential quadrature amplitude modulated signal and the first input of the differential amplifier; and a second variable impedance device coupled between the means for receiving the differential quadrature amplitude modulated signal and the second input of the differential amplifier; and means for controlling the values of the first and second variable impedance devices; and the second controllable impedance means comprises:

a third variable impedance device coupled between the first input and the first output of the differential amplifier;

a fourth variable impedance device coupled between the second input and the second output of the differential amplifier, and means responsive to the cosine component representative signal for controlling the third and fourth variable impedance devices.

8. The audio detector circuit of claim 7 wherein the third variable impedance device comprises:

a first field effect transistor having source, drain and gate electrodes;

the first field effect transistor source and drain electrodes being coupled between the differential amplifier first input and the differential amplifier first output; and the means for producing the cosine component representative signal being coupled to gate electrode of the first field effect transistor;

the fourth variable impedance device comprises:

a second field effect transistor having source, drain and gate electrodes, the second field effect transistor source and drain electrodes being coupled between the differential amplifier second input and the differential amplifier second output; and the means for producing the cosine component representative signal being coupled to gate electrode of the second field effect transistor.

9. The audio detector circuit of claim 7 wherein:

the first variable impedance device comprises:

a first field effect transistor having source, drain and gate electrodes, the first field effect transistor source and drain electrodes being coupled between the means for receiving the compatible quadrature amplitude modulated signal and the differential amplifier first input;

the second variable impedance device comprises:

a second field effect transistor having source, drain and gate electrodes;

the second field effect transistor source and drain electrodes being coupled between the means for receiving the compatible quadrature amplitude modulated signal and the differential amplifier second input.

10. The audio detector circuit of claim 7 further comprising:

means responsive to the compatible quadrature amplitude modulated signal for generating a signal of a prescribed phase representative of the carrier of the compatible quadrature amplitude modulated signal; and means coupled to the first and second outputs of the differential amplifier responsive to the prescribed phase carrier representative signal for frequency multiplying the differential signal between the first and second outputs of the differential amplifier with the prescribed phase carrier representative signal.

11. The audio detector circuit of claim 10 wherein the frequency multiplying means comprises:

first and second inputs;

first and second outputs;

first, second, third and fourth transmission gates each having a signal input terminal, a signal output terminal; and a pair of clocking terminals;

the first output of the differential amplifier being coupled to the first frequency multiplier input;

the second output of the differential amplifier being coupled to the second frequency multiplier input;

the first frequency multiplier input being coupled to the signal inputs of the second and third transmission gates;

the second frequency multiplier input being coupled to the signal inputs of the first and fourth transmission gates;

the signal outputs of the first and second transmission gates being coupled the first frequency multiplier output;

the signal outputs of the third and fourth transmission gates being coupled the second frequency multiplier output; and means responsive to the prescribed phase carrier representative signal for switching the first, second, third and fourth transmission gates on and off at the rate of the prescribed carrier signal whereby the differential signal at the frequency multiplier outputs includes a signal component corresponding to one of the L+R and L−R audio signals.

12. The audio detector circuit of claim 11 further comprising means coupled to the first and second outputs of the frequency multiplier for converting the differential signal between the frequency multiplier first and second outputs to a single ended signal including a signal component corresponding to one of the L+R and L−R audio signals.

13. An audio detector circuit for producing L+R and L−R audio signals from a compatible quadrature amplitude modulated signal having L+R, L−R and cosine components comprising:

means for receiving the compatible quadrature amplitude modulated signal;

means responsive to the compatible quadrature amplitude modulated signal for generating a signal of prescribed phase representative of the carrier of the quadrature amplitude modulated signal;

means responsive to the received compatible quadrature amplitude modulated signal for producing a signal representative of the cosine component therein; and detecting means responsive to the received compatible quadrature amplitude modulated signal for producing one of the L+R and L−R audio signals comprising:

an amplifier including input means and output means;

first controllable impedance means coupled between the means for receiving the compatible quadrature amplitude modulated signal and the amplifier input means;

means responsive to the prescribed phase carrier representative signal for switching the first controllable impedance means between first and second values at a rate corresponding to the carrier frequency; and second controllable impedance means coupled between the input and output means of the amplifier; and means responsive to the cosine component representative signal for controlling the value of the second controllable impedance means.

14. The audio detector circuit of claim 13 wherein second controllable impedance means comprises:

at least one field effect transistor having source, drain and gate electrodes, the source electrode and drain electrodes being coupled between the input means and the output means of the amplifier; and the cosine component representative signal producing means being coupled to the gate electrode of the at least one variable impedance field effect transistor.

15. The audio detector circuit of claim 13 wherein the first controllable impedance means comprises:

at least one field effect transistor having source, drain and gate electrodes, the source and drain electrodes being coupled between the means for receiving the compatible quadrature amplitude modulated signal and the amplifier input means; and the prescribed phase carrier representative signal generating means being coupled to the gate electrode of the at least one field effect transistor.

16. The audio detector circuit of claim 13 wherein:

the compatible quadrature amplitude modulated signal is a differential signal;

the means for receiving the compatible quadrature amplitude modulated signal comprises first and second terminals;

the amplifier comprises a differential amplifier having first and second inputs and first and second outputs;

the first controllable impedance means comprises:

a first variable impedance device coupled between the first terminal of the means for receiving the differential quadrature amplitude modulated signal and the first input of the differential amplifier;

a second variable impedance device coupled between the second terminal of the means for receiving the differential quadrature amplitude modulated signal and the first input of the differential amplifier;

a third variable impedance device coupled between the second terminal of the means for receiving the differential quadrature amplitude modulated signal and the second input of the differential amplifier, and a fourth variable impedance device coupled between the first terminal of the means for receiving the differential quadrature amplitude modulated signal and the second input of the differential amplifier; and means responsive to the prescribed phase carrier representative signal for controlling the values of the first, second, third and fourth controllable impedance devices; and the second controllable impedance means comprises:

a fifth variable impedance device coupled between the first input and first output of the differential amplifier;

a sixth variable impedance device coupled between the second input and second output of the differential amplifier; and means responsive to the cosine component representative signal for controlling the fifth and sixth variable impedance devices.

17. The audio detector circuit of claim 16 wherein:

the fifth variable impedance device comprises a first field effect transistor having source, drain and gate electrodes, the first field effect transistor source and drain electrodes being coupled between the differential amplifier first input and the differential amplifier first output;

the cosine component representative signal producing means being coupled to the gate electrode of the first field effect transistor; and the second variable impedance device comprises a second field effect transistor having source, drain and gate electrodes, the second field effect transistor source and drain electrodes being coupled between the differential amplifier second input and the differential amplifier second output; and the cosine component representative signal producing means being coupled to the gate electrode of the second field effect transistor; and

18. The audio detector circuit of claim 16 wherein:

the first variable impedance device comprises a first field effect transistor having source, drain and gate electrodes;

the first field effect transistor source and drain electrodes being coupled between the first terminal of the means for receiving the compatible quadrature amplitude modulated signal and the differential amplifier first input;

the second variable impedance device comprises a second field effect transistor having source, drain and gate electrodes, the second field effect transistor source and drain electrodes being coupled between the second terminal of the means for receiving the compatible quadrature amplitude modulated signal and the differential amplifier first input;

the third variable impedance device comprises a third field effect transistor having source, drain and gate electrodes;

the third field effect transistor source and drain electrodes being coupled between the second terminal of the means for receiving the compatible quadrature amplitude modulated signal and the differential amplifier second input;

the fourth variable impedance device comprises a fourth field effect transistor having source, drain and gate electrodes;

the fourth field effect transistor source and drain electrodes being coupled between the first terminal of the means for receiving the compatible quadrature amplitude modulated signal and the differential amplifier second input; and the means for controlling the values of the first, second, third and fourth variable impedance devices comprises:

means for applying the prescribed phase carrier representative signal to the gate electrodes of the first, second, third and fourth field effect transistors.

19. The audio detector circuit of claim 18 wherein:

the means for applying the prescribed phase carrier representative signal to the gate electrodes of the first, second, third and fourth field effect transistors comprises:

means responsive to the prescribed phase carrier representative signal for generating a first prescribed phase clock signal and a first prescribed phase inverse clock signal;

the first prescribed phase clock signal being coupled to the gate electrodes of the second and fourth field effect transistors; and the first prescribed phase inverse clock signal being coupled to the gate electrodes of the first and third field effect transistors.

20. The audio detector circuit of claim 19 wherein the prescribed phase carrier representative signal is a 0° phase carrier frequency representative signal whereby the phase detector forms a signal corresponding to the L+R audio signal.

21. The audio detector circuit of claim 19 wherein the prescribed phase carrier representative signal is a 90° phase carrier frequency representative signal whereby the phase detector forms a signal corresponding to the L−R audio signal.

22. An audio detector circuit for producing L+R and L−R audio signals from a compatible quadrature amplitude modulated signal having an L+R amplitude modulation component, L+R and L−R phase modulation components and a cosine component comprising:

means for receiving the compatible quadrature amplitude modulated signal;

an envelope detector responsive to the amplitude modulation of the received compatible quadrature amplitude modulated signal for forming a first audio signal;

an in-phase detector responsive to the received compatible quadrature amplitude modulated signal for forming an output signal having L+R audio signal component;

a quadrature phase detector responsive the received compatible quadrature amplitude modulated signal for forming an output signal including an L−R audio signal component;

means responsive to the first audio signal from the envelope detector and the output signal from the in-phase detector for generating a signal representative of the cosine component of the received compatible quadrature amplitude modulated signal; and means responsive to the output signal of the quadrature phase detector for generating an in-phase clock signal and a quadrature phase clock signal at the carrier frequency of the rate of the received compatible quadrature amplitude modulated signal;

wherein the in-phase detector comprises:

a first amplifier including input means and output means;

first controllable impedance means coupled between the means for receiving the compatible quadrature amplitude modulated signal and the amplifier input means;

means responsive to in-phase clock signal for switching the first controllable impedance means between first and second values at a rate corresponding to the carrier frequency;

second controllable impedance means coupled between the input and output means of the amplifier; and means responsive to the cosine component representative signal for controlling the value of the second controllable impedance means.

23. The audio detector circuit of claim 22 wherein the quadrature phase detector comprises:

a second amplifier including input means and output means;

third controllable impedance means coupled between the means for receiving the compatible quadrature amplitude modulated signal and the second amplifier input means;

means responsive to the quadrature phase clock signal for switching the third controllable impedance means between first and second values at a rate corresponding to the carrier frequency;

fourth controllable impedance means coupled between the input and output means of the second amplifier; and means responsive to the cosine component representative signal for controlling the value of the fourth controllable impedance means.

24. A synchronous detector for a Compatible Quadrature Amplitude Modulation (C-QUAM) broadcast signals having L+R, L−R and cosine components comprising:

first and second input terminals for receiving the C-QUAM broadcast signal;

a differential mode operational amplifier having a positive input, a negative input, a positive output and a negative output;

means responsive to the received C-QUAM broadcast signal for generating a first control signal corresponding to the cosine component thereof;

means responsive to the received C-QUAM broadcast signal for generating a second control signal corresponding to the carrier component of the C-QUAM broadcast signal;

first variable resistor means responsive to the first control signal for coupling the positive amplifier output terminal to the positive amplifier input terminal;

second variable resistor means responsive to the first control signal for coupling the negative amplifier output terminal to the negative amplifier input terminal; and third variable resistor means coupled between the first and second terminals and the amplifier input terminals responsive to the second control signal for coupling the first and second terminals to the positive and negative input terminals of the differential amplifier means.

* * * * *